US008508112B2

(12) United States Patent
Losco et al.

(10) Patent No.: US 8,508,112 B2
(45) Date of Patent: Aug. 13, 2013

(54) DISCHARGE LAMP WITH SELF-SUPPORTING ELECTRODE STRUCTURES

(75) Inventors: Jeffry W. Losco, Phillipsburg, NJ (US); Dennis J. Losco, Easton, PA (US); Joseph W. Losco, Bangor, PA (US); Dennis A. Losco, Easton, PA (US)

(73) Assignee: Superior Quartz Products, Inc., Bethlehem, PA (US)

( * ) Notice: Subject to any disclaimer, the term of this patent is extended or adjusted under 35 U.S.C. 154(b) by 227 days.

(21) Appl. No.: 13/116,388

(22) Filed: May 26, 2011

(65) Prior Publication Data

US 2011/0291555 A1 Dec. 1, 2011

Related U.S. Application Data

(60) Provisional application No. 61/349,359, filed on May 28, 2010.

(51) Int. Cl.
*H01J 1/02* (2006.01)
*H01J 61/04* (2006.01)

(52) U.S. Cl.
USPC ..... 313/267; 313/343; 313/624

(58) Field of Classification Search
USPC ..... 313/234, 231.31, 321.41, 267, 272, 313/343, 620–621, 624
See application file for complete search history.

(56) References Cited

U.S. PATENT DOCUMENTS

| | | | | |
|---|---|---|---|---|
| 1,980,572 | A | 11/1934 | Callahan | |
| 2,096,236 | A | 10/1937 | Freedman | |
| 2,323,142 | A | 6/1943 | Leverenz | |
| 2,344,552 | A | 3/1944 | Knochel et al. | |
| 6,400,089 | B1 | 6/2002 | Salvermoser et al. | |
| 7,199,374 | B2 | 4/2007 | Salvermoser et al. | |
| 2005/0275329 | A1 | 12/2005 | Hiraki et al. | |
| 2007/0278953 | A1 * | 12/2007 | Hagiwara et al. | 313/578 |

OTHER PUBLICATIONS

International Search Report and Written Opinion, PCT/US2011/038088, dated Aug. 9, 2011.

* cited by examiner

*Primary Examiner* — Karabi Guharay
(74) *Attorney, Agent, or Firm* — Lerner, David, Littenberg, Krumholz & Mentlik, LLP

(57) ABSTRACT

A discharge lamp comprises an electrode assembly structured to induce tension in certain of the component electrodes and compression in others of the component electrodes. The balancing tensile and compressive forces cause the electrode assembly to be a unitary, self-supporting structure, which can be inserted into a prefabricated envelope and in which the forces are induced independently of interaction with the envelope. The electrodes in tension may be relatively thin wires and the electrodes in compression may be relatively thicker rods. The electrode assembly may include concentric arrangements of electrodes, with a plurality of rod counter-electrodes spaced circumferentially around a thin wire electrode, or a plurality of thin wire electrodes spaced circumferentially around a central rod counter-electrode. In other embodiments, a counter-electrode may have a flat, polished surface facing one or more electrodes overlying the surface. Dummy electrodes may equalize bending loads on the counter-electrode.

14 Claims, 11 Drawing Sheets

DISCHARGE LAMP WITH SELF-SUPPORTING ELECTRODE STRUCTURES

CROSS-REFERENCE TO RELATED APPLICATIONS

This application claims the benefit of the filing date of U.S. Provisional Patent Application No. 61/349,359 filed May 28, 2010, the disclosure of which is hereby incorporated herein by reference.

BACKGROUND OF THE INVENTION

The present invention relates to electric discharge lamps and other similar electrical discharge devices.

Electric discharge lamps are known per se. For example, U.S. Pat. No. 6,400,089 and U.S. Pat. No. 7,199,374, the disclosures of which are hereby incorporated herein by reference, disclose corona discharge lamps. In such devices, a negatively charged electrode is spaced apart from a grounded counter electrode in a chamber containing an excimer-forming gas. The negatively charged electrode is typically highly curved (e.g., forming a sharp point or a wire with a small radius), while the grounded electrode typically has low curvature (e.g., in the shape of a flat plate). Applying a high negative voltage to the highly curved negative electrode creates a high intensity electric field around the negative electrode, which provides emission of free electrons. Near the negative electrode, the high field accelerates free electrons to an energy level sufficient to cause excimer formation. An excimer is a short-lived molecule which typically consists of two atoms in an excited or high-energy state, and may include atoms which will not normally bond with one another in the unexcited or ground state. Remote from the negative electrode, the field is lower, and is below the level required to substantially ionize the gas. By configuring the electric field to accelerate electrons to at least the energy required to form excimers in one portion of the field, while keeping the field strength in at least one region of the field below that required to substantially ionize the gas, an arc will not form between the negative electrode and the counter electrode. Such a non-arcing discharge is referred to as a corona discharge. In one application, the excimers emit electromagnetic radiation such as light upon decay of the excimers. For example, certain noble gas containing excimers will emit ultraviolet light upon decay. If the wall of the chamber is transparent or translucent to the light generated by the decay of the excimers, the light can pass out of the chamber.

Further improvement in the construction of such discharge devices would be desirable.

BRIEF SUMMARY OF THE INVENTION

One aspect of the present invention provides an electrode assembly for a discharge lamp. An electrode assembly according to this aspect of the invention desirably includes two connecting units spaced apart from one another and a plurality of electrodes extending codirectionally with one another between the connecting units. Preferably, at least one of the electrodes is in compression and urges the connecting units away from one another, and at least one of the electrodes is in tension and urges the connecting units towards one another. Desirably, this results in the electrodes and connecting units cooperatively forming a self-supporting subassembly that is structurally independent of any element of an enclosing envelope.

According to one aspect of the invention, at least one of the electrodes is a rod and at least one of the electrodes is a wire. The cross-sectional area of the wire may be substantially smaller than that of the rod. The rod may be in compression while the wire is in tension. According to an aspect of the invention, the electrode assembly may comprise a plurality of rods arranged concentrically about a longitudinal axis of the wire. According to another aspect of the invention, the electrode assembly may comprise a plurality of wires arranged concentrically about a longitudinal axis of the rod. In accordance with one aspect of the invention, at least one of the electrodes is a negative electrode arranged to carry a negative charge, and at least one of the electrodes is a positive electrode arranged to carry a positive charge.

A further aspect of the invention provides a discharge lamp incorporating an electrode assembly as discussed above.

Yet another aspect of the invention provides a method of assembling a discharge lamp. A method according to this aspect of the invention desirably includes inserting an electrode assembly, as discussed above, into a hollow interior portion of an elongated envelope through an opening in one end of the envelope. According to an aspect of the invention, the method may further include sealing the opening in the end of the envelope with an end cap.

DETAILED DESCRIPTION

Figure 1:
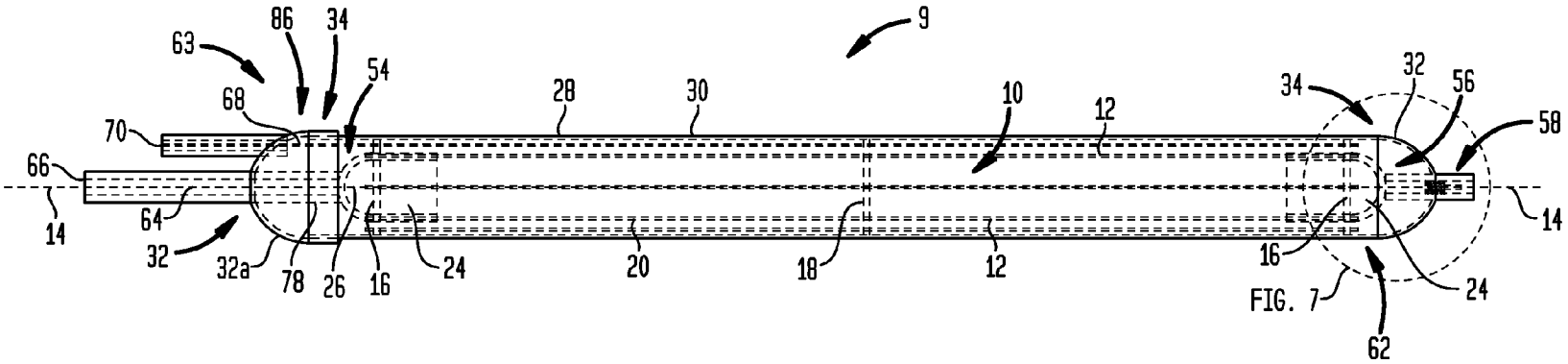
FIG. 1 is a side view of a discharge lamp in accordance with one embodiment of the invention.

With reference to FIG. 1, a discharge lamp 9 in accordance with one embodiment of the present invention includes an electrode assembly 10. The electrode assembly 10 includes a plurality of elongated peripheral electrodes 12 spaced circumferentially around and generally parallel to a central longitudinal axis 14 of the assembly 10. At each end of the electrodes 12 is an end support 16, which connects together the various electrodes 12. One or more intermediate supports 18 may be located between the end supports 16. The electrodes 12 together with the intermediate and end supports 18, 16 comprise a counter-electrode assembly 20. At each end of the counter-electrode assembly 20 is an end connector 24. Connected between the end connectors 24 is a central electrode 26 extending substantially along the central longitudinal axis 14 of the electrode assembly 10. The counter-electrode assembly 20 together with the end connectors and the central electrode 26 comprise the electrode assembly 10.

As discussed below, the electrode assembly 10 is preferably a self-supporting structure which can be inserted into an elongated tubular envelope 28. An exemplary envelope 28 may be approximately 20 inches in length. The envelope 28 includes an elongated tube 30 and two end caps 32, all of which are preferably constructed of a material capable of transmitting UV light, such as fused quartz or fused silica. However, the envelope 28 may be constructed of many other suitable translucent materials. For example, if the lamp is designed to transmit visible light instead of UV light, a material such as soda-lime glass may be used. The end caps 32 can be connected to the open ends 34 of the tube 30 in order to seal the envelope 28 closed. The sealed envelope 28 preferably encloses an excimer forming gas.

In use, the lamp 9 is connected to a power source such that the central electrode 26 receives a charge (e.g., a negative voltage) and the peripheral electrodes 12 are grounded. By adjusting the applied voltage applied between the central electrode 26 and the peripheral electrodes 12, a corona discharge may be generated, preferably resulting in electromagnetic radiation.

Figure 2A:
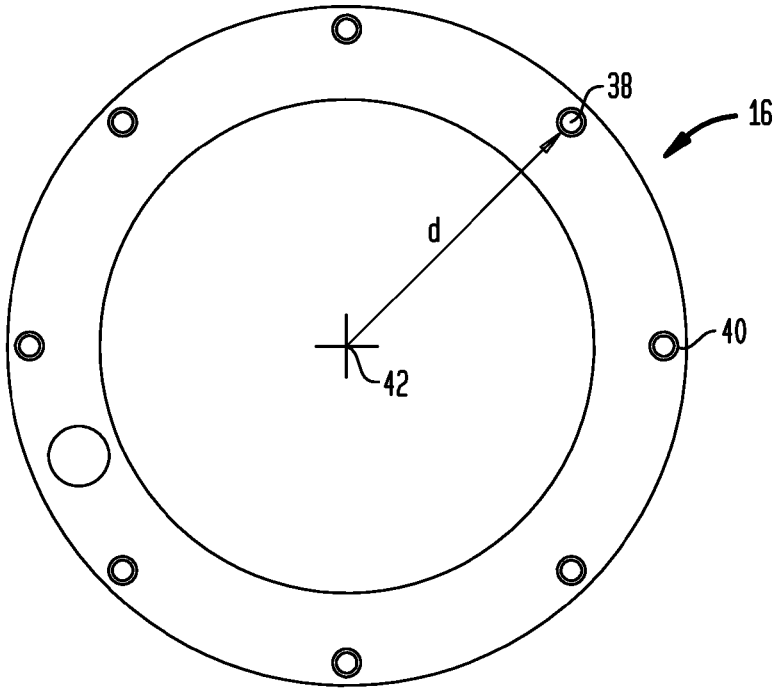
FIGS. 2A and 2B are front and side views, respectively, of a component of the discharge lamp of FIG. 1.
Figure 2B:
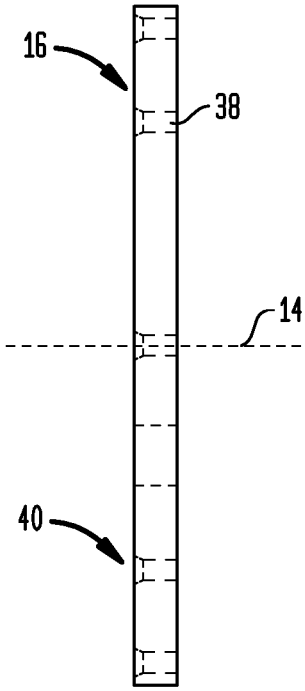

As shown in FIGS. 2A-B, the end support 16 comprises a generally flat ring having a plurality of pass-through holes 38 spaced apart around the ring. Each of the holes 38 is sized to securely accept a peripheral electrode 12 therethrough. In this regard, the holes 38 may include a beveled opening 40 to make the insertion of the electrodes 12 into the holes 38 easier. The holes are preferably located at a fixed distance d from the center 42 of the end support 16, which is located on the central longitudinal axis 14 when the end supports 16 are assembled with the other components of the counter-electrode assembly 20. In that way, a uniform distance is preferably defined between the central electrode 26 carrying a particular charge and all of the grounded peripheral electrodes 12. This preferably results in an even electric field around the central electrode 26, since having one peripheral electrode 12 spaced closer to the central electrode 26 than the others could create an uneven field and could result in arcing. The end support 16 is preferably constructed of an electrically conductive material, such as molybdenum, so that all of the peripheral electrodes 12 are electrically connected. The outer diameter of the end support 16 is preferably approximately equal to an inner diameter of the tube portion 30 of the envelope 28. The inner diameter of the end support 16 is preferably approximately equal to the outer diameter of a portion of the end connector 24, as discussed below. As also discussed below, the end connectors 24 are preferably constructed to prevent any disruption to the electric field and/or arcing caused by the inner diameter of the conductive end support 16 being spaced closer to the central electrode 26 than the peripheral electrodes 12.

Figure 3:
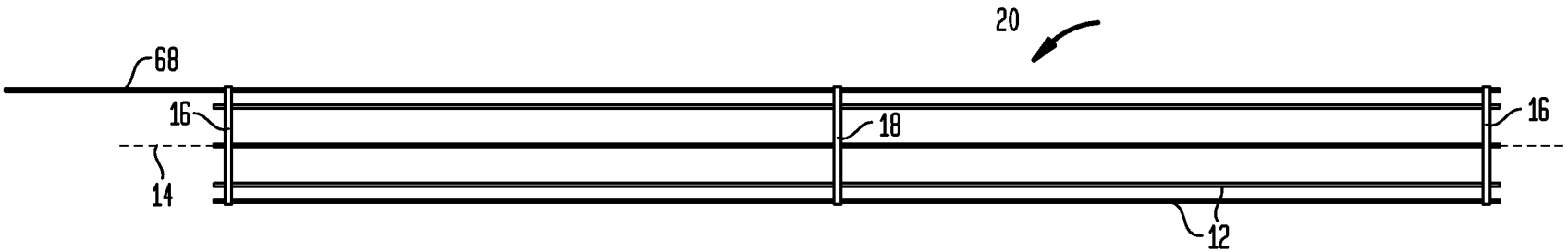
FIG. 3 is a side view of a subassembly of the discharge lamp of FIG. 1.

As shown in FIG. 3, the counter-electrode assembly 20 is assembled by connecting together a plurality of peripheral electrodes 12 by end supports 16 at each end. One or more intermediate supports 18 may be located between the end supports 16. The intermediate supports 18 are preferably constructed with the same geometry as the end supports 16. The intermediate supports 18 are, however, preferably constructed of a dielectric material, such as quartz, instead of an electrically conductive material. In that way, no disruption to the electric field and/or arcing will be caused by an inner diameter of the intermediate support 18 being spaced closer to the central electrode 26 than the peripheral electrodes 12. The intermediate supports 18 preferably help keep the peripheral electrodes 12 substantially linear between each end support 16, and thus help to maintain the distances between the peripheral electrodes 12 and the central electrode 26 along the length of the electrode assembly 10.

Figure 4:
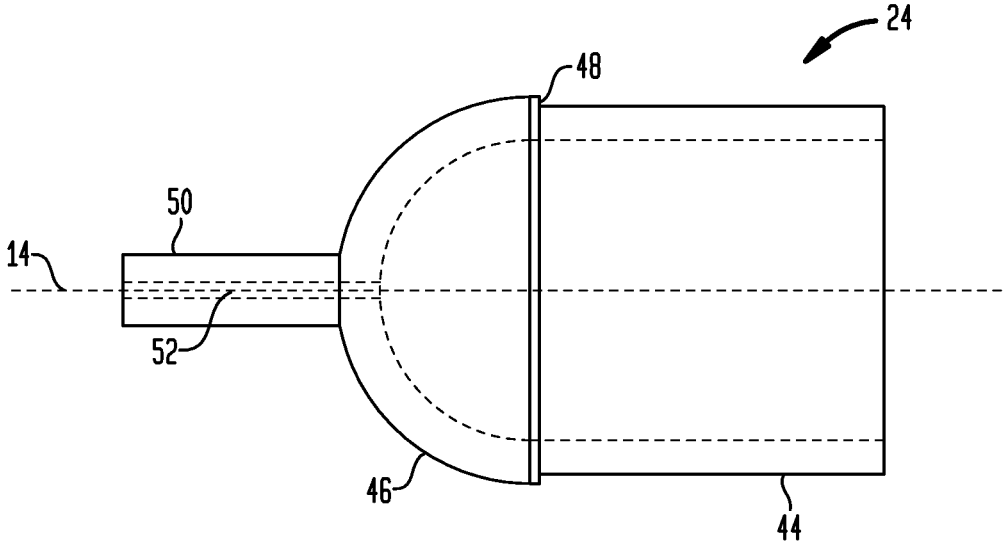
FIG. 4 is a side view of a component of the discharge lamp of FIG. 1.

The end connector 24 (FIG. 4) is preferably a unitary component formed from a dielectric material, such as quartz. The end connector 24 includes a cylindrical collar portion 44 having an outer diameter slightly smaller than the inner diameter of the end support 16, so that the end support 16 can be disposed around the collar portion 44. The dielectric collar portion 44 prevents arcing between the central electrode 26 and the electrically conductive end support 16. The end connector 24 also includes a hemispherical portion 46 having an outer diameter slightly larger than an outer diameter of the collar portion 44, thus forming a lip 48 between the hemispherical portion 46 and the collar portion 44. Extending from the hemispherical portion 46 substantially along the central longitudinal axis 14 is a capillary member 50 in the shape of an elongated tube. The capillary member 50 defines an internal passageway 52 sized to receive the central electrode 26.

Figure 5A:
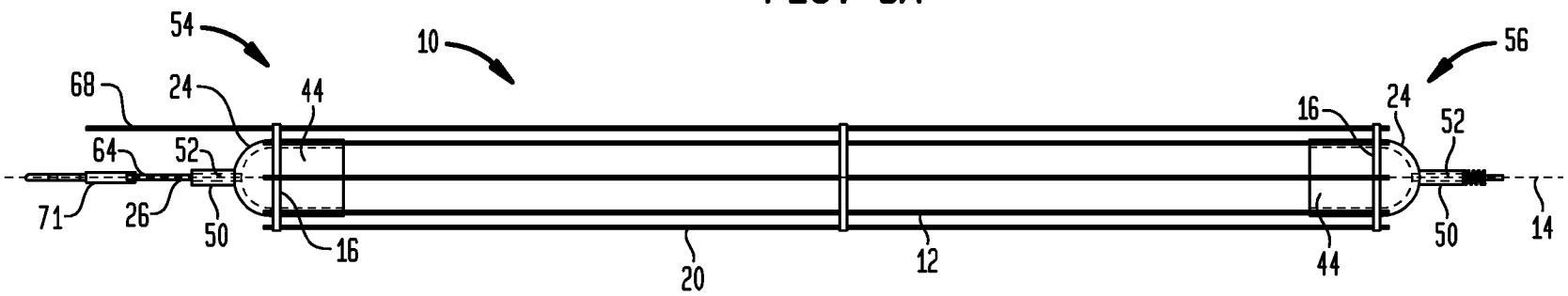
FIG. 5A is a side view of a subassembly of the components of FIG. 3 together with the components of FIG. 4 and other components.
Figure 5B:
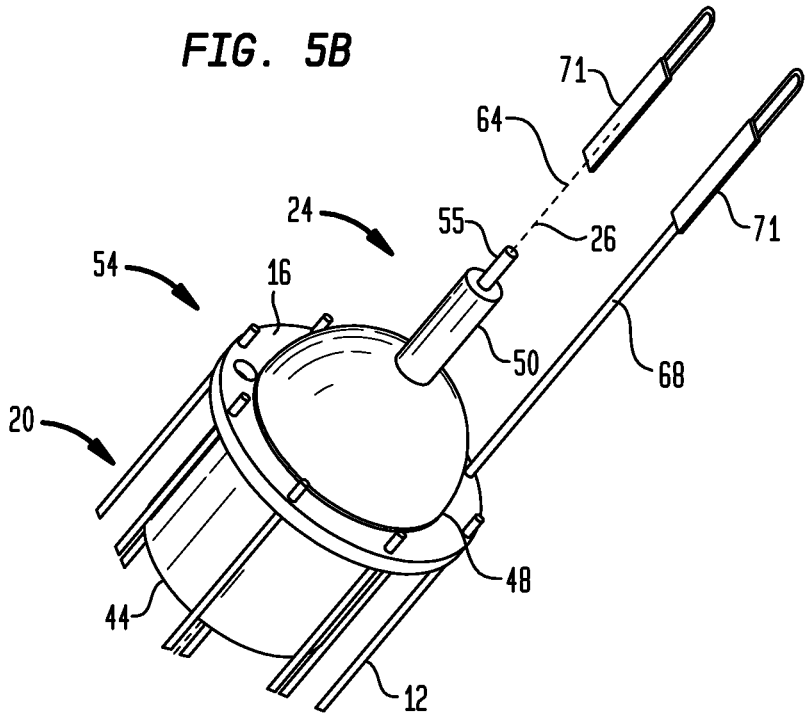
FIGS. 5B and 5C are perspective views of portions of the subassembly of FIG. 5A.
Figure 5C:
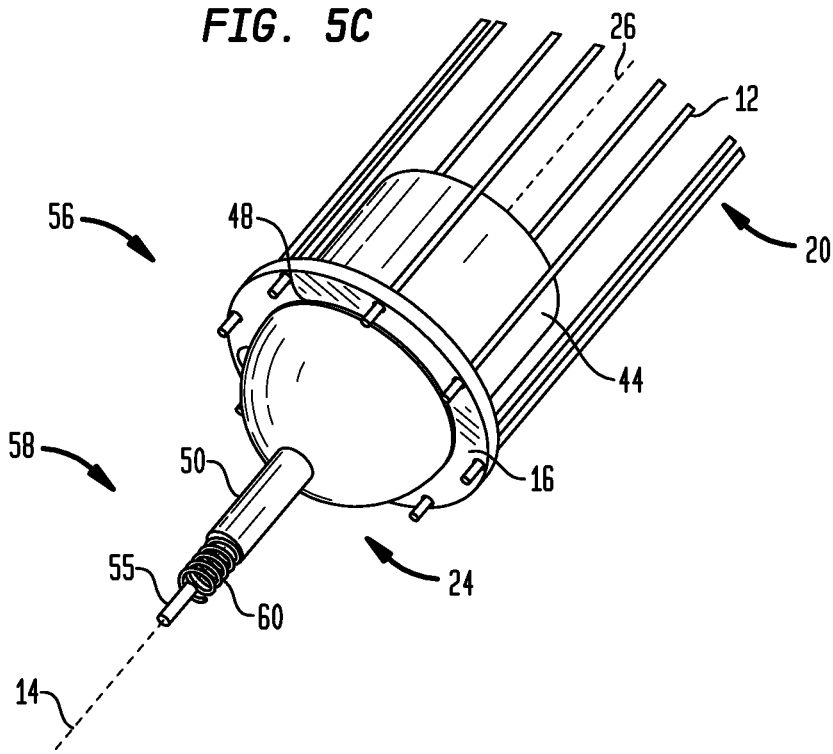

As shown in FIGS. 5A-C, the electrode assembly 10 is assembled with an end connector 24 positioned on each end of the counter-electrode assembly 20, such that the end supports 16 are received around the collar portions 44 and abut the lips 48. The central electrode 26 extends between the end connectors 24 along the central longitudinal axis 14, with each end of the central electrode 26 passing through the passageways 52. On one end 54 of the electrode assembly 10, as shown in FIG. 5B, the central electrode 26 is secured to the capillary member 50. This may be accomplished by providing a crimp 55 in the form of a small metal tube having an outer diameter larger than the passageway 52 of the capillary 50. The crimp 55 is affixed to the central electrode 26 by, for example, compressively deforming it around the electrode 26. Once it is affixed to the central electrode 26, the crimp 55 will engage the capillary member 50 of the end connector 24 when the central electrode is pulled towards the other end 56 of the electrode assembly 10, thus preventing the central electrode 26 from moving any further towards the other end 56 of the electrode assembly 10. Although this connection between the central electrode 26 and the end connector 24 only prevents longitudinal movement of the central electrode in one direction, a suitable connection could also be formed which prevents longitudinal movement of the central electrode 26 in either direction.

On the other end 56 of the electrode assembly 10, as shown in FIG. 5C, the central electrode 26 is attached to the end connector 24 via a tensioning assembly 58, which maintains tension in the central electrode 26. The tensioning assembly 58 includes a spring 60 that engages the capillary member 50 on one end. The other end of the spring engages a component, such as a crimp 55, that is affixed to the central electrode 26. Although not shown in FIG. 5C, a spacer member, such as a tubular portion of quartz, may be disposed on the central electrode 26 between the spring 60 and the crimp 55. The spacer member may have an inner diameter larger than the electrode 26 but smaller than the outer diameter of the crimp 55. The outer diameter of the spacer member is preferably larger than the outer diameter of the spring 60. In this manner, the spacer member transfers forces between the spring 60 and the central electrode 26 via the crimp 55.

The tensioning assembly 58 places central electrode 26 in tension so that the force application by the central electrode 26 urges the end connectors 24 towards one another. This force is transmitted to the end supports 16, and is thus transmitted to the peripheral electrodes 12. Thus, the peripheral electrodes 12 are in compression. The compressive force is transmitted to the peripheral electrodes by the engagement between the lips 48 of the end connectors 24 and the end supports 16. The end connectors 24 together with the end supports 16 thus act as structural connections between the central electrode 26 and the peripheral electrodes 12, which allow the transmission of forces between the electrodes 26, 12.

The central electrode 26 may be structured differently than the peripheral electrodes 12. For example, in the embodiment illustrated in FIGS. 1-8, the central electrode 26 is in the form of a wire, and the peripheral electrodes 12 are in the form of rods. By a "wire," it is meant that the electrode is very thin and highly flexible, whereas a "rod" is meant to encompass an electrode which is substantially thicker than the wire and has some degree of rigidity. For example, an exemplary rod may have a diameter in the range of 0.020 inches to 0.125 inches, or even larger, with one preferred diameter being approximately 0.039 inches. An exemplary wire, on the other hand, may have a diameter in the range of 0.001 to 0.020 inches, with one preferred diameter being approximately 0.008 inches. The wire also desirably has a high curvature, particularly if it is to carry a negative electric charge. Both electrodes may be made of tungsten or any other suitable metal. Although the rods forming the peripheral electrodes 12 are intended to have some rigidity, they are preferably thin enough so as to minimally interfere with the electromagnetic radiation emanating out through the envelope 28. Accordingly, the peripheral electrodes 12 may have a tendency to buckle under the applied compressive forces. Therefore, preferably the provision of one or more intermediate supports 18 provides lateral support which limits or prevents the buckling of the peripheral electrodes 12.

The counteracting tensile and compressive forces carried by the electrodes 26, 12 of the electrode assembly 10 preferably cause the assembly 10 to be a self-supporting structure. Thus, the assembly acts as a unitary component that can be inserted relatively easily into a prefabricated envelope 28. The self-supporting tensile and compressive forces within the electrode assembly 10 are generated as a result of interactions within the assembly 10 itself, and not as a result of interactions with other components outside of the assembly, such as the envelope 28. Thus, the electrode assembly 10 does not rely on interactions with any portion of the envelope 28 in order to produce those self-supporting forces.

Before inserting the unitary self-supporting electrode assembly 10 into the envelope 28, the end cap 32 at one end 62 of the envelope 28 is preferably joined to the tube 30. The electrode assembly 10 may then be inserted through the open end 34 of the tube 30 at the other end 63 of the envelope 28. As shown in FIG. 1, the electrode assembly 10 may be arranged so that the end 56 having the tensioning assembly 58 is inserted first towards the sealed end 62 of the envelope 28. After the electrode assembly 10 is inserted into the tube 30 of the envelope 28, the envelope 28 may be sealed closed by connecting an end cap 32 to the end 34 of the tube 30 at the open end 63 of the envelope 28.

At least one of the end caps 32 is preferably designed to permit electrical leads to pass through it, in order to provide electrical connections to the electrodes. An electrical connection 64 to the central electrode 26 preferably extends out through the end cap 34 along the central longitudinal axis 14, passing through a central opening 66 in the end cap 32 that is positioned on the axis 14 (see FIG. 1). The electrical connection 64 to the central electrode 26 may even comprise, in whole or in part, the central electrode 26 itself extending out through the end cap 34. The electrical connection 68 to the counter-electrode assembly 20 preferably extends from one of the peripheral electrodes 12 out through an opening 70 in the end cap 34 spaced from the central axis 14. The electrical connection to the counter-electrode assembly 20 may even comprise, in whole or in part, one of the peripheral electrodes 12 itself extending through the opening 70. The opening 70 may not be aligned with one of the peripheral electrodes 12, in which case the electrical connection 68 may bend between the opening 70 and the closest end support 16. Both electrical connections 64, 68 preferably include foil elements 71 (see FIG. 5B) for passing through a pinch seal region of the envelope, as is customary in the art.

Figure 6:
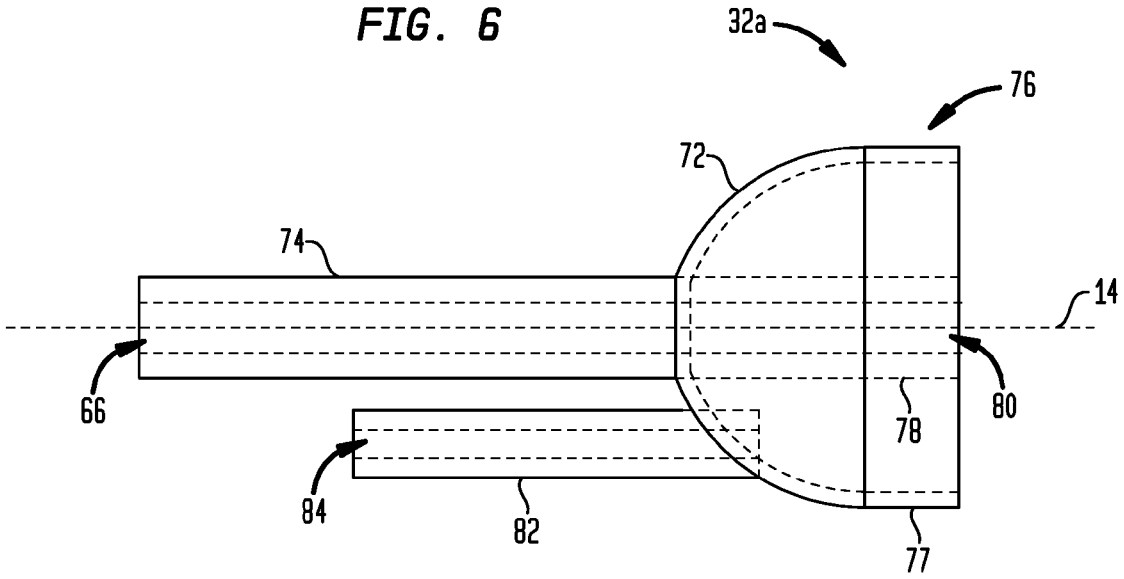
FIG. 6 is a side view of a component of the discharge lamp of FIG. 1.

A preferred structure for an end cap 32 that permits electrical leads to pass though it, designated end cap 32*a*, is illustrated in FIG. 6. As shown in that figure, the end cap 32*a* is preferably a unitary component formed from the same material as the tube 30, such as fused quartz. The end cap 32*a* includes a hollow hemispherical portion 72 having an open connecting end 76 for connecting to the end 34 of the tube 30. The diameter of the hemispherical portion 72 is preferably slightly larger than the outer diameter of the envelope tube 30, so that the end cap 32*a* may receive the end 34 of the tube 30 in an overlapping engagement. In this regard, a cylindrical extension 77 may extend from the connecting end 76 of the end cap 32*a* for overlapping with a portion of the end 34 of the envelope tube 30. Extending from the other end of the hemispherical portion 72 is a tubular capillary member 74, which extends away from the connecting end 76 of the end cap 32*a*. The capillary member 74 defines the opening 66 through which the electrical connection 64 to the central electrode 26 may pass. A tubular abutment portion 78 extends inward from the capillary member 74 towards the connecting end 76 of the end cap 32. The capillary member 74, along with abutment portion 78, both define an internal passageway 80. The passageway 80 is sized to allow the capillary member 50 of one of the end connectors 24 to be inserted therein. This arrangement permits the electrical connection 64 to the central electrode 26 to extend out through the opening 66 in the end of the capillary member 74. The end cap 32*a* also includes a second capillary member 82 spaced away from the central axis 14. The second capillary member 82 includes a passageway 84 sized to permit the electrical connection 68 to the counter-electrode assembly 20 to pass therethrough.

The other end cap 32, designated 32*b*, may not be constructed to permit electrical leads to pass though it, in which case a second capillary member 82 may not be provided. However, as illustrated in FIGS. 7 and 8, which show the end cap 32*b* joined to the end 34 of the envelope tube 30, the end cap 32*b* does preferably include a first capillary member 74, an abutment portion 78, and an internal passageway 80 sized to allow the capillary member 50 of one of the end connectors 24 to be inserted therein.

Figure 7:
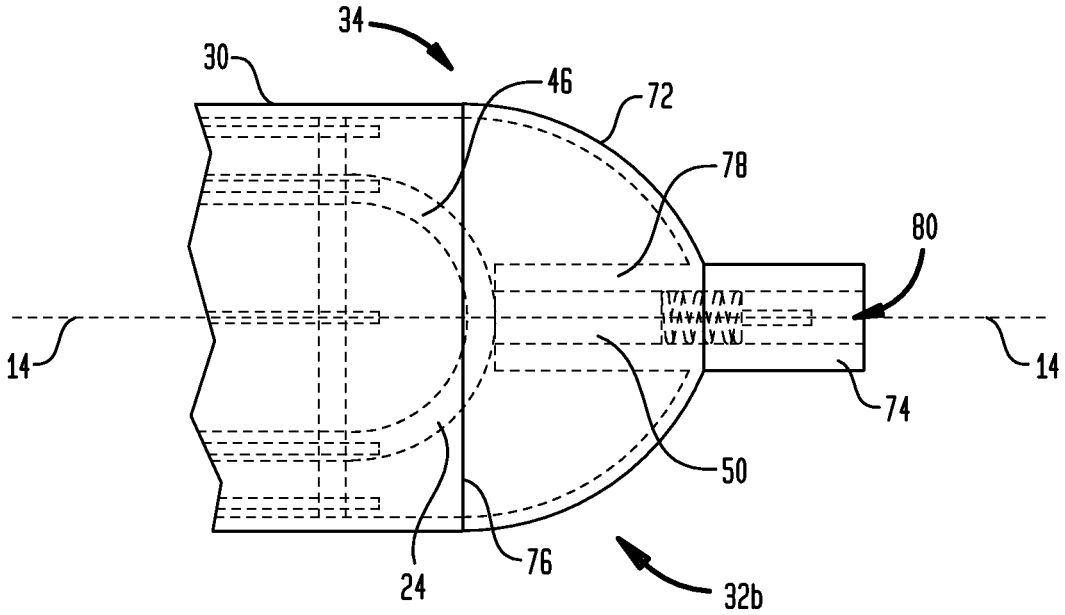
FIG. 7 is a side enlarged view of a detail of FIG. 1.
Figure 8:
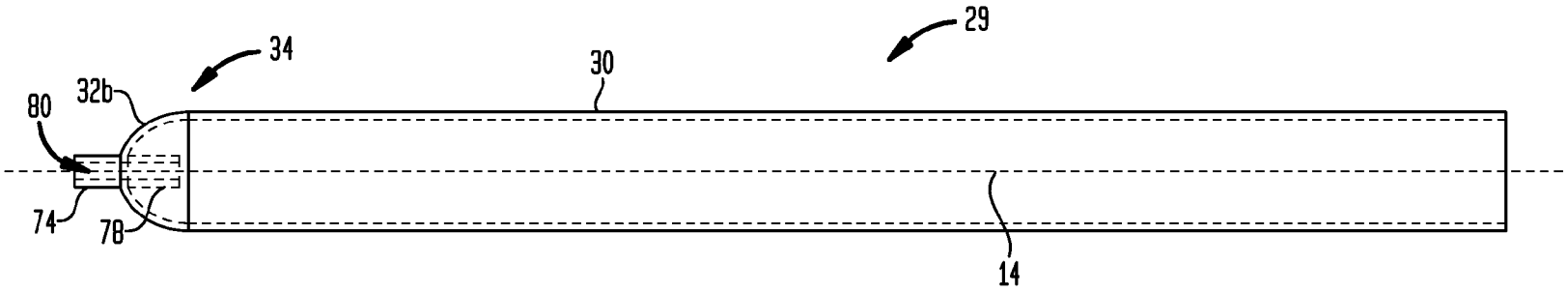
FIG. 8 is a side view of a subassembly of the discharge lamp of FIG. 1.

With reference to FIGS. 1 and 7, the end caps 32 are preferably constructed such that, when they are assembled to the open ends 34 of the envelope tube 30, the abutment portions 78 and the passageways 80 of the end caps 32 interact with the respective end connectors 24 of the electrode assembly 10. In particular, the passageways 80 are arranged to receive the capillary members 50 with a relatively small clearance in the radial direction, so as to at least partially secure the electrode assembly 10 in the radial direction. The radial securement provided to the electrode assembly 10 by the passageways 80 is preferably supplemented by radial securement provided by the small clearances between the outer diameters of the end and intermediate supports 16, 18 and the inner diameter 30 of the tubular portion 30 of the envelope 28. Furthermore, in addition to radial securement, the end caps 32 preferably secure the longitudinal position of the electrode assembly along the central axis 14. In particular, the abutment portions 78 are preferably dimensioned to abut the hemispherical portions 46 of the end connectors 24. By abutting the end connectors 24 on each end of the electrode assembly 10, the abutment portions of the end caps 32 preferably constrain the longitudinal position of the electrode assembly within the envelope 28. Thus, the electrode assembly 10 is preferably a "free floating" assembly within the envelope 28, but is constrained from substantial movement within the envelope 28 by abutting portions of the envelope.

As shown in FIG. 1, the longitudinal dimensions of the electrode assembly 10, the tubular portion 30 of the envelope 28, and the abutment portions 78 of the end caps 32 may further be selected so that the closest end support 16 is spaced apart from the connection 86 between the end cap 32*a* and the end 34 of the envelope tube 30. In particular, if the envelope components are made of a material that is fused at a particularly high temperature, such as fused quartz, the spacing of the end supports 16 away from the connection 86 will preferably prevent the metal material of the end supports 16 from melting or otherwise being damaged from the high temperatures generated when the end cap 32*a* is fused to the envelope tube 30.

In accordance with one embodiment of the present invention, a preferred method of assembling the discharge lamp 9 may begin with the construction of the counter-electrode assembly 20. In particular, the peripheral electrodes 12 may be passed through the holes 38 in the end supports 16 and through the holes in one or more intermediate supports 18. The electrodes 12 may then be affixed to the rings, such as by brazing or welding. Alternatively, a mechanical connection may be used, such as threading the electrodes into threaded openings in the end supports 16, or threading one or more nuts onto threaded portions of the electrodes to tighten against the end supports 16.

After the counter-electrode assembly 20 is constructed, the end connectors 24 may be connected to each end of the counter-electrode assembly 20. The central electrode 26 having a crimp 55 affixed to one end may then be passed through the passageways 52 in the end connectors 24. The spring 60 may be placed on the central electrode 26 at the opposite end from the crimp 55, and then moved into position abutting the end connector 24. A spacer may then be positioned on the central electrode 26, followed by another crimp 55. The spring 60 may then be deflected and the second crimp 55 deformed at a desired location on the central electrode 26, in order to secure the central electrode 26 under the tension applied by the spring 60.

Before inserting the electrode assembly 10 into the envelope 28, end cap 32*b* may be connected to the envelope tube 30 to form partial envelope assembly 29 (see FIG. 8). The end cap 32*b* may be connected by first sliding the cylindrical extension 77 of the end cap over the end of the tube 30. The end cap 32*b* may then be sealed to the tube 30 by using a torch to heat the extension 77 and applying a radially directed compressive force to fuse the end cap 32*b* with the tube 30. The capillary 74 of the end cap 32*b* is preferably sealed closed either before or after the end cap 32*b* is assembled to the envelope tube 30, by, for example, fusing a cover (not shown) to the end of the capillary 74 or compressively deforming the end of the capillary 74 while heating.

After this portion of the envelope 28 is assembled, the electrode assembly 10 may be inserted into the envelope 28 until the end connector 24 at one end 56 of the assembly 10 abuts the abutment portion 78 of the end cap 32*b*. The electrical connections 64, 68 are then fed through the respective capillaries 74, 82 of the end cap 32*a*, as the end cap 32*a* is slid onto the open end of the tube 30. The extension 77 of the end cap 32*a* is then fused to the tube 30 in a similar manner to that performed in connection with the other end cap 32*b*. Finally, the gas within the envelope 28 is evacuated, the envelope is backfilled with an excimer forming gas (e.g., noble gases such as He, Ne, Ar, Kr, or Xe), and the envelope 28 is sealed closed. The gases may be transferred through one of the electrical connection capillaries 74, 82 or through a separate port (not shown) provided in one of the end caps 32 for that purpose. The electrical connection capillaries 74, 82 may be sealed by pinching a portion of each of the capillaries 74, 82 under heat, as is customary in the art, until a pinch seal is formed against the foil elements 71 of the electrical connections 64, 68 passing through the capillaries 74, 82. If a separate port is provided for transferring gases into and out of the envelope 28, the gases may be transferred through the port in any order with respect to the sealing of the electrical connection capillaries 74, 82. For example, the envelope 28 may first be evacuated, followed by sealing the electrical connection capillaries 74, 82, then backfilling the envelope with gas, and finally sealing the separate gas transfer port. Any portion of the capillaries 74, 82 extending beyond the pinch seal after it is formed may be cut off, if desired.

Figure 9:
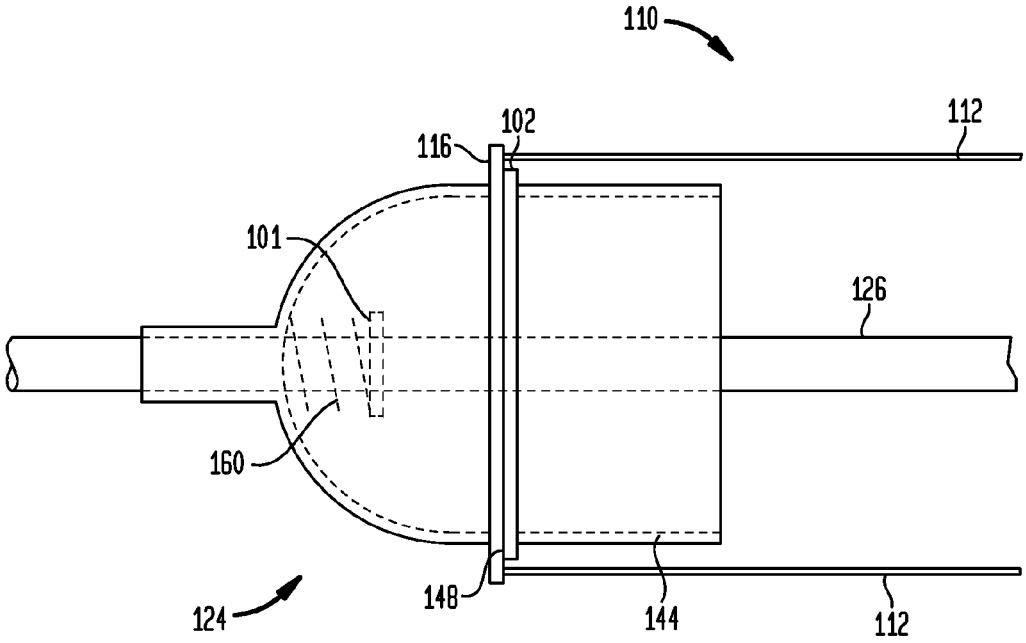
FIG. 9 is a diagrammatic side view of a portion of a discharge lamp in accordance with further embodiments of the invention.

In accordance with another embodiment of the present invention, as schematically illustrated in FIG. 9, the components that carry the tensile and compressive forces may be reversed. For example, the peripheral electrodes 112 may be arranged to be under tension and the central electrode 126 may be arranged to be under compression. It is noted that, in the embodiment of FIG. 9, similar components to those of the embodiment described above are given similar reference numerals.

The central electrode 126 of FIG. 9 may be a relatively thick rod, while the peripheral electrodes 112 may be relatively thin wires. Because the central electrode 126 is located in the center of an envelope, it is believed that its thickness will cause less of a disruption to electromagnetic radiation emanating out of the envelope. Accordingly, the central electrode 126 may have a substantial thickness and rigidity, and the need for intermediate supports to prevent buckling may not be needed. However, such supports may still be provided in order to help secure the positions of the peripheral electrodes 112 along their lengths. Such intermediate supports may also be constructed so as to have inner diameters that are substantially the same as the outer diameter of the central electrode 126, so as to provide additional support to the central electrode 126.

As shown in FIG. 9, the compressive and tensile forces are induced by a spring 160. The spring 160 may be arranged to engage the inside of the end connector 124 on one end and may engage the central electrode 126 on the other end, such as by a flange 101 or other connection (e.g., crimping member) to the central electrode 126. The tensile and compressive forces induced by the spring 160 are thus transferred between the central electrode 126 and the peripheral electrodes 112 via end connectors 124. The end connectors 124 may include a flange 102 along the collar portion 144, which provides a lip 148 configured to abut the end support 116. In this manner, by securing one of the end connectors 124 to the central electrode 126 and by connecting the other end connector 124 to the central electrode via the spring 160, the spring 160 will tend to urge the end connectors 124 away from one another. The lip 148 of each flange 102 will thus pull on the end supports 116, resulting in a tensioning of the peripheral electrodes 112. Preferably this arrangement causes the resulting electrode assembly 110, like the electrode assembly 10 discussed above, to act as a unitary, self-supporting structure independent of interactions with an envelope.

In the embodiment illustrated in FIG. 9, the electrode assembly 110 is preferably electrically connected such that the peripheral electrodes receive a negative charge and the central electrode is grounded. However, this is not required, and these charges may be reversed. The central electrode 126 may also be constructed as a tubular element defining a central channel, which may carry a cooling fluid. In such a design, the end cap capillary along the longitudinal axis, through which the central electrode 126 passes out of the envelope, may be constructed to be large enough to receive the tubular portion of the electrode. In an alternative embodiment, the cooling fluid may pass through the end cap via a separate conduit that connects to the central electrode 126 within the envelope.

Figure 10A:
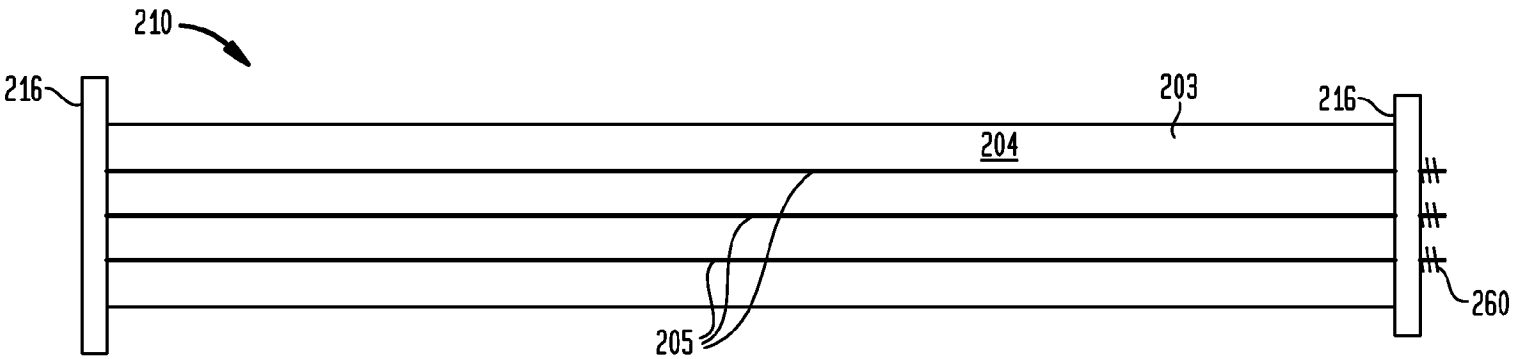
FIG. 10A is a diagrammatic top view of a subassembly of a discharge lamp in accordance with further embodiments of the invention.
Figure 10B:
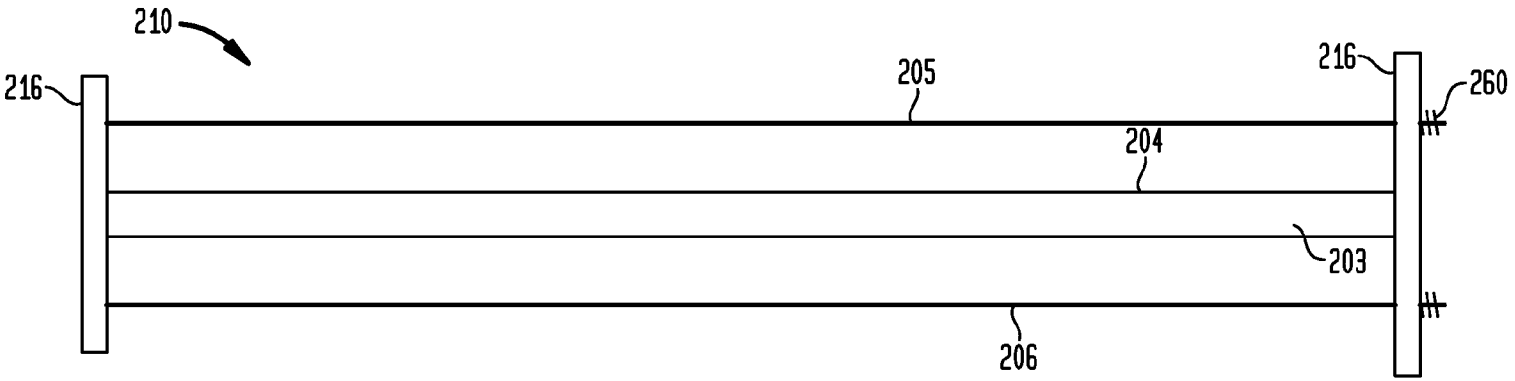
FIG. 10B is a diagrammatic side view of the subassembly of FIG. 10A.

Although the above-described embodiments illustrate systems of concentrically arranged electrodes, the present invention is not so limited. For example, a counter-electrode may be formed so as to have a large, generally flat surface facing one or more charged electrodes. Additional electrodes may also be provided on the opposite side of the counter-electrode from the first set of electrodes. As an illustrative example, FIGS. 10A-B schematically depict an embodiment in which a counter-electrode is in the shape of an elongated, generally rectangular plate 203. The plate 203 preferably includes at least one substantially flat surface 204. Each end of the plate is connected to an end support 216. The end supports 216 position one or more electrodes 205 overlying and generally parallel to the flat surface 204. The electrodes 205, which may be in the form of relatively thin wires, may be tensioned by tensioning assemblies 260, similar to those described above. The tension in the electrodes 205 is transmitted to the plate 203 by the end supports 216, resulting in a compressive force felt by the plate 203. This, again, preferably results in a unitary, self-supporting electrode assembly 210 that can be inserted into a suitably designed envelope, and in which the tensile/compressive forces are induced independently of interactions with the envelope.

The plate-shaped counter-electrode 203 is preferably grounded, while a negative charge may be provided to the electrodes 205. In this manner, an electric field may be generated between the plate 203 and the electrodes 205, preferably resulting in a corona discharge and the emission of electromagnetic radiation. In order to increase the efficiency of the lamp, and also its directionality, the surface 204 may be a polished surface, which reflects substantial amounts of incident electromagnetic radiation back towards the electrodes 205.

Because the tensioned electrodes 205 are located on one side of the plate 203, a resultant bending force will be induced in the plate 203. In order to counteract the bending, an additional set of electrodes 206 (either charged or electrically isolated "dummy" electrodes) may be provided on the opposite side of the plate 203 from the tensioned electrodes 205. Dummy electrodes 206 would be structured similarly to electrodes 205, including the tensioning assemblies 260, but would not be arranged to carry an electric charge.

In other embodiments of the present invention, the single-directionally emitting aspect of the electrode assembly 210 of FIGS. 10A-B may be incorporated into the concentrically arranged embodiments. For example, the peripheral electrodes 12 on one side of the electrode assembly 10 of the embodiment of FIGS. 1-8 may be replaced with a semi-cylindrical plate having a polished surface. The plate may be electrically connected in common with the peripheral electrodes 12 so that the plate serves as an additional peripheral electrode. Alternatively, the plate may electrically isolated. In another arrangement, such a semi-cylindrical plate may be an additional component located between the envelope 28 and the peripheral electrodes 12 on one side of the electrode assembly 10. In further alternatives, one half of the envelope 28 may be made reflective, such as by plating the inner or outer surfaces of the envelope 28 with a mirror-like finish.

Various other modifications can be made to any or all of the above embodiments within the scope of the present invention. For example, the end supports, such as end supports 16, need not be constructed of an electrically conductive material. In an alternative embodiment, the end supports may be constructed of a dielectric material and may include integrated electrical connections among associated electrodes. In another alternative, the electrodes connected to the end supports need not be electrically connected through the end supports, and separate electrical connections may instead be provided to each of the electrodes.

Similarly, the intermediate supports need not be constructed of a dielectric material. For example, the intermediate supports 18 may be made of electrically conductive materials, but the supports may be designed so as to connect to the peripheral electrodes without extending inwardly of the electrodes (so as to prevent arcing and disruption to the electric field). Alternatively, the intermediate supports may be substantially constructed of an electrically conductive material, but a dielectric electrode shield (similar to the cylindrical collar portions 44 of the end connectors 24) may be provided between the inner diameter of the intermediate supports and the central electrode.

In further alternative embodiments, the electrode assemblies need not be constrained longitudinally by abutting portions of the end connectors on each end of the assemblies. In an alternative embodiment, one end of an electrode assembly may abut an abutment portion of an end connector, while the other end of the assembly is spaced from the abutment portion of the other end connector by a device which permits limited movement, such as a spring. In this way, any expansion or contraction of the entire electrode assembly caused by heating and cooling of the assembly may be accommodated.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An electrode assembly for a discharge lamp, comprising:

(a) two connecting units spaced apart from one another; and (b) a plurality of electrodes extending codirectionally with one another between the connecting units, each of the electrodes being attached to each of the connecting units, at least one of the electrodes being in compression and urging the connecting units away from one another, at least one of the electrodes being in tension and urging the connecting units toward one another so that the electrodes and connecting units cooperatively form a self-supporting subassembly structurally independent of any element of an enclosing envelope.

2. The electrode assembly of claim 1, wherein at least one of the plurality of electrodes is a rod and at least one of the plurality of electrodes is a wire, the wire having a cross-sectional area substantially smaller than the rod, wherein the rod is in compression and the wire is in tension.

3. The electrode assembly of claim 2, wherein the electrode assembly comprises a plurality of rods arranged concentrically about a longitudinal axis of the wire.

4. The electrode assembly of claim 2, wherein the electrode assembly comprises a plurality of wires arranged concentrically about a longitudinal axis of the rod.

5. The electrode assembly of claim 1, further comprising a reinforcement unit disposed between the first and second connecting units, the reinforcement unit being adapted to provide lateral support to at least one of the plurality of electrodes.

6. The electrode assembly of claim 1, wherein at least one of the plurality of electrodes is a negative electrode arranged to carry a negative charge, and wherein at least one of the plurality of electrodes is a positive electrode arranged to carry a positive charge.

7. The electrode assembly of claim 6, further comprising a reinforcement unit disposed between the first and second connecting units, the reinforcement unit being adapted to provide lateral support to at least one of the plurality of electrodes, wherein the reinforcement unit comprises a dielectric material extending in a zone between the negative electrode and the positive electrode.

8. The electrode assembly of claim 1, wherein at least one of the connecting units includes a dielectric.

9. A discharge lamp comprising:

(a) an envelope in the form of an elongated tube having a hollow interior portion; and (b) an electrode assembly as recited in claim 1, the electrode assembly being received within the hollow interior portion of the envelope.

10. The discharge lamp of claim 9, wherein the envelope has an opening at each end thereof, each of the openings being sealed by an end cap.

11. The discharge lamp of claim 10, wherein at least one of the connecting units of the electrode assembly includes a metal material.

12. The discharge lamp of claim 11, wherein the electrode assembly is positioned within the interior portion of the envelope such that the at least one of the connecting units including a metal material is spaced apart from the end caps.

13. A method of assembling a discharge lamp, comprising inserting an electrode assembly as recited in claim 1 into a hollow interior portion of an elongated envelope through an opening in one end of the envelope.

14. The method of claim 13, further comprising sealing the opening in the end of the envelope with an end cap.

* * * * *